US007185372B2

(12) United States Patent
Lin

(10) Patent No.: US 7,185,372 B2
(45) Date of Patent: Mar. 6, 2007

(54) DIVING MASK

(75) Inventor: Yuan-Po Lin, Mouli Hsien (TW)

(73) Assignee: Water Square Sports Co., Ltd., Sanchong (TW)

( * ) Notice: Subject to any disclaimer, the term of this patent is extended or adjusted under 35 U.S.C. 154(b) by 0 days.

(21) Appl. No.: 11/169,725

(22) Filed: Jun. 30, 2005

(65) Prior Publication Data

US 2007/0000034 A1 Jan. 4, 2007

(30) Foreign Application Priority Data

Sep. 29, 2004 (TW) ..... 93215469 U

(51) Int. Cl.
*A61F 9/02* (2006.01)

(52) U.S. Cl. ..... 2/440; 24/170; 351/43

(58) Field of Classification Search ..... 2/428, 2/450, 452, 454; 351/43
See application file for complete search history.

(56) References Cited

U.S. PATENT DOCUMENTS

| | | | | |
|---|---|---|---|---|
| 6,276,794 | B1 * | 8/2001 | Chiang | 351/43 |
| 6,350,030 | B2 * | 2/2002 | Fujima | 351/43 |
| 6,691,377 | B2 * | 2/2004 | Pan | 24/170 |
| 6,789,296 | B2 * | 9/2004 | Yang | 24/170 |

* cited by examiner

*Primary Examiner*—Katherine Moran
(74) *Attorney, Agent, or Firm*—Lowe Hauptman & Berner, LLP

(57) ABSTRACT

A diving mask includes a mask portion and a pair of side buckles respectively extending rearwards from the left and right sides of the mask portion. A structure that permits an easy adjustment in the relative positions between the mask portion and the pair of the side buckles is adopted in the diving mask. Two coupling blocks made of flexible material are respectively defined between two lateral sides of the mask portion and the pair of the side buckles. The coupling blocks permit the pair of side buckles to move upwards/downwards or leftwards/rightwards relative to the mask portion.

2 Claims, 4 Drawing Sheets

DIVING MASK

BACKGROUND OF THE INVENTION

1. Field of the Invention

The present invention relates to a diving mask, and more particularly to a structure that permits an easy adjustment in the relative positions between a mask portion of the diving mask and a pair of the side buckles.

2. Description of Related Art

In order to observe objects under water more conveniently, a diver needs to wear a diving mask. The diving mask comprises a mask portion and a pair of side buckles respectively extending rearwards from the left and right sides of the mask portion. The mask portion further includes a solid lens frame and a pair of lenses fixedly mounted in the lens frame. The mask portion covers the diver's face. Furthermore, a head band is extended through holes defined in the pair of side buckles. By adjusting the length of the head band, the diver is able to wear the diving mask comfortably.

However, conventional side buckles and the mask portion are fixedly linked. Thus, the pair of side buckles does not permit moving upwards/downwards or leftwards/rightwards relative to the mask portion, which causes inconvenience to the diver.

Nowadays, side buckles are pivotally connected to the mask portion, which permits the side buckles to move upwards or downwards relative to the mask portion. However, as for a diver who has a wide face, the mask portion of the aforementioned diving mask will still press against the diver's face, as the side buckles do not permit moving leftwards or rightwards relative to the mask portion.

Therefore, the invention provides a structure for connecting a diving mask to a pair of side buckles to mitigate or obviate the aforementioned problems.

SUMMARY OF THE INVENTION

The main objective of the present invention is to provide a structure that permits an easy adjustment in the relative positions between a mask portion of a diving mask and a pair of side buckles. The pair of side buckles is able to move upwards/downwards or leftwards/rightwards relative to the mask portion, thus a diver will feel comfortable when wearing the diving mask.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
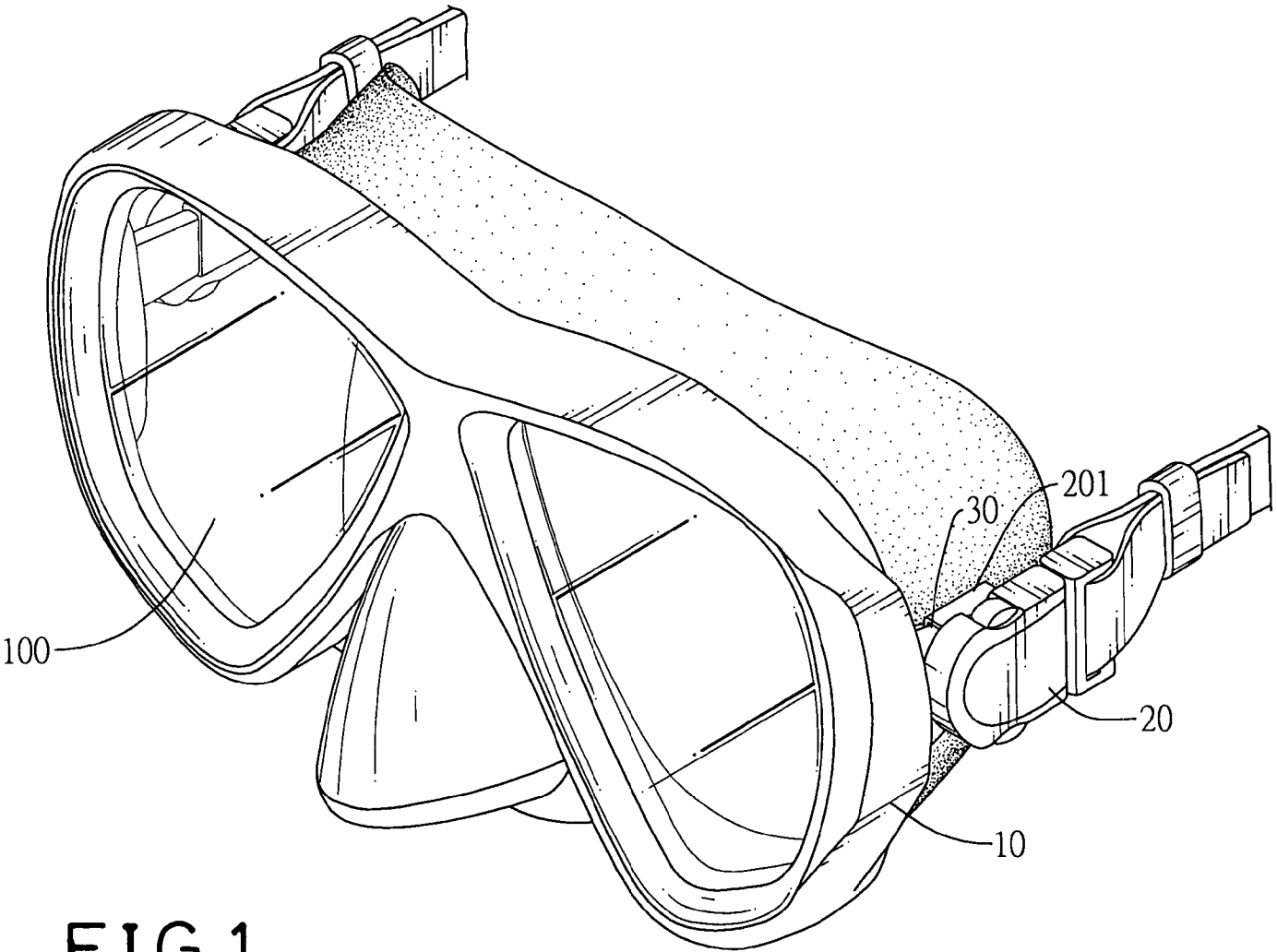
FIG. 1 is a perspective view of an embodiment of a diving mask in accordance with the present invention.
Figure 2:
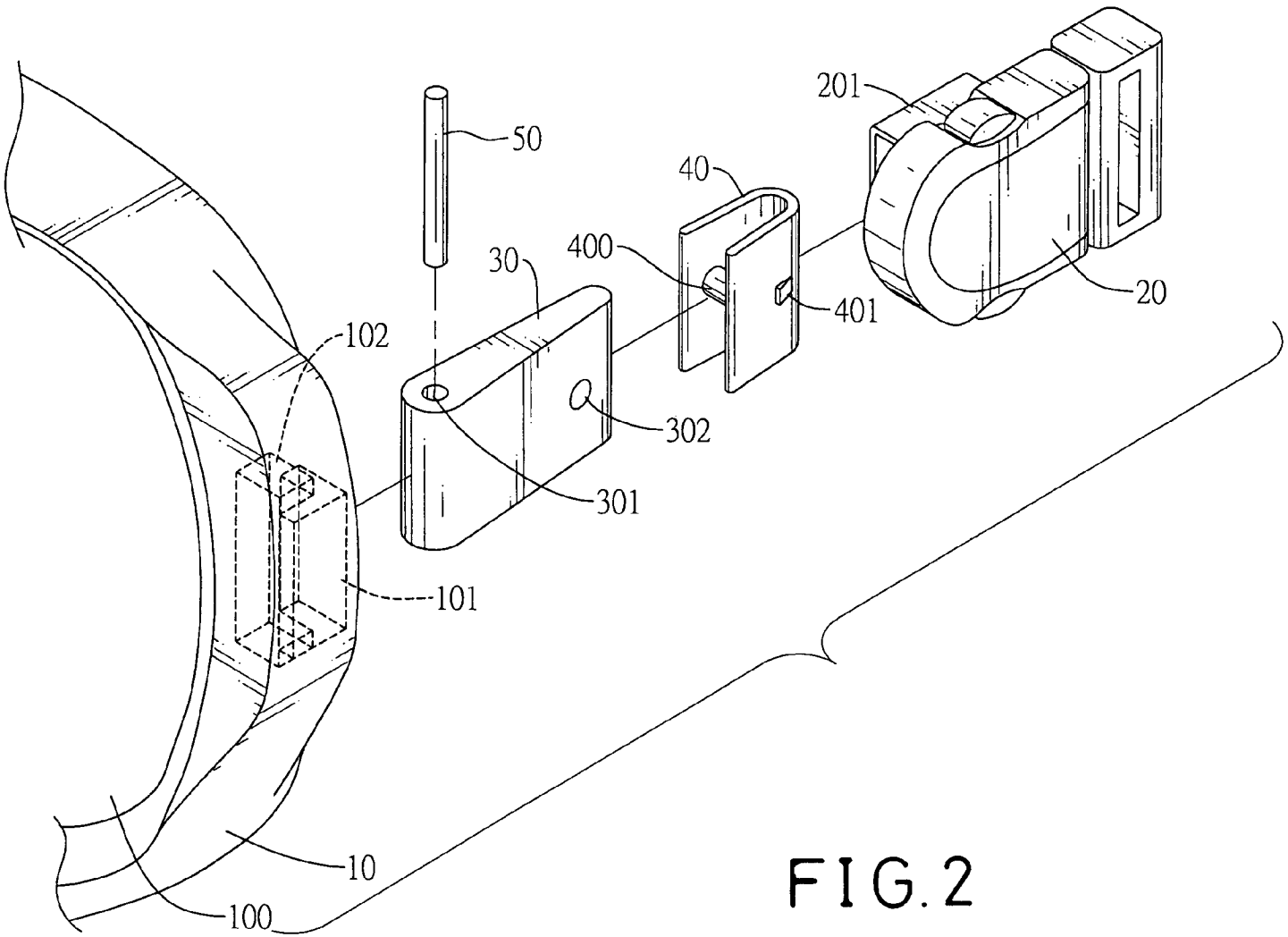
FIG. 2 is an exploded perspective view of the embodiment of the diving mask in accordance with the present invention.
Figure 3:
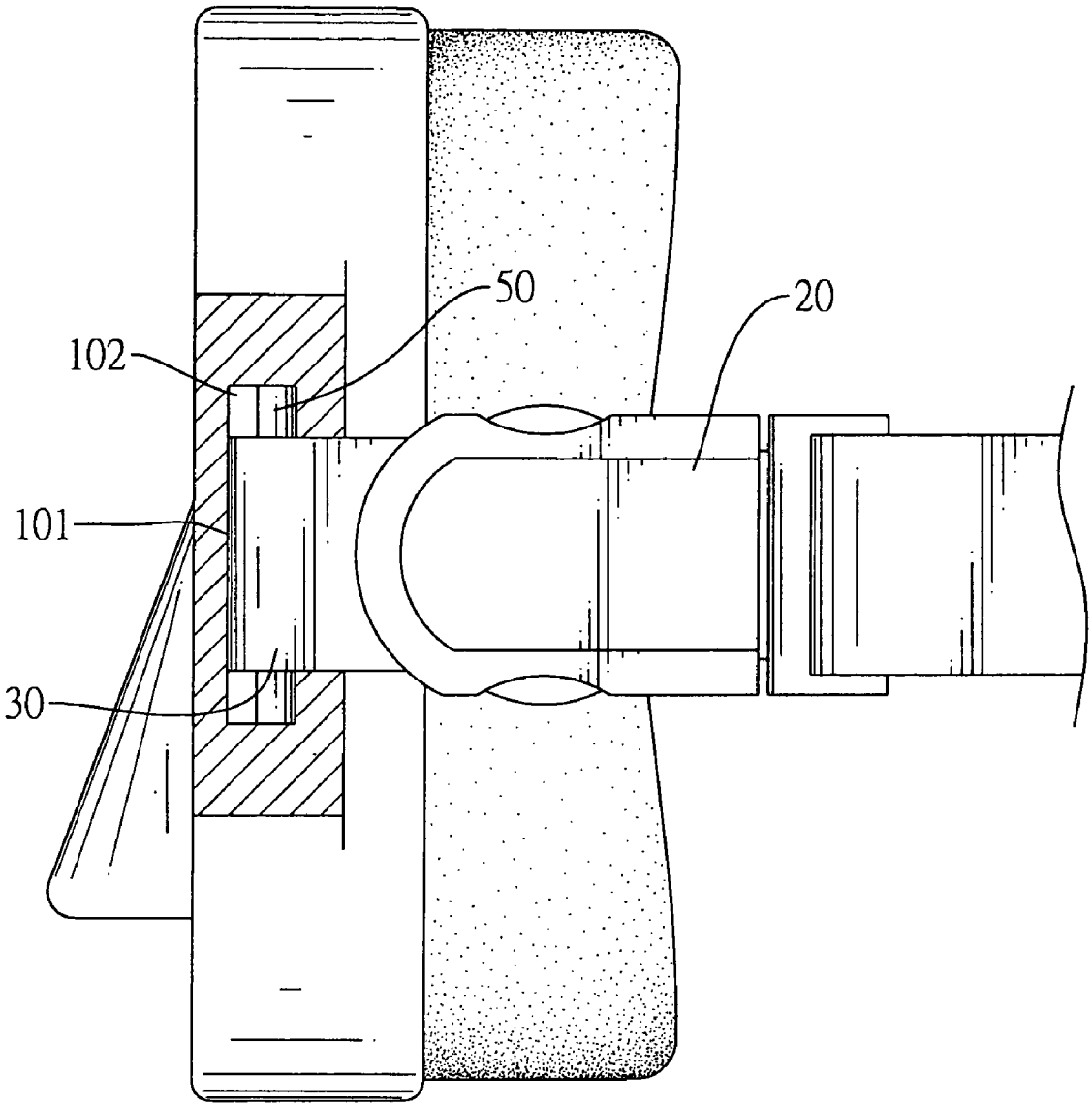
FIG. 3 is a longitudinal direction sectional view of the present invention.
Figure 4:
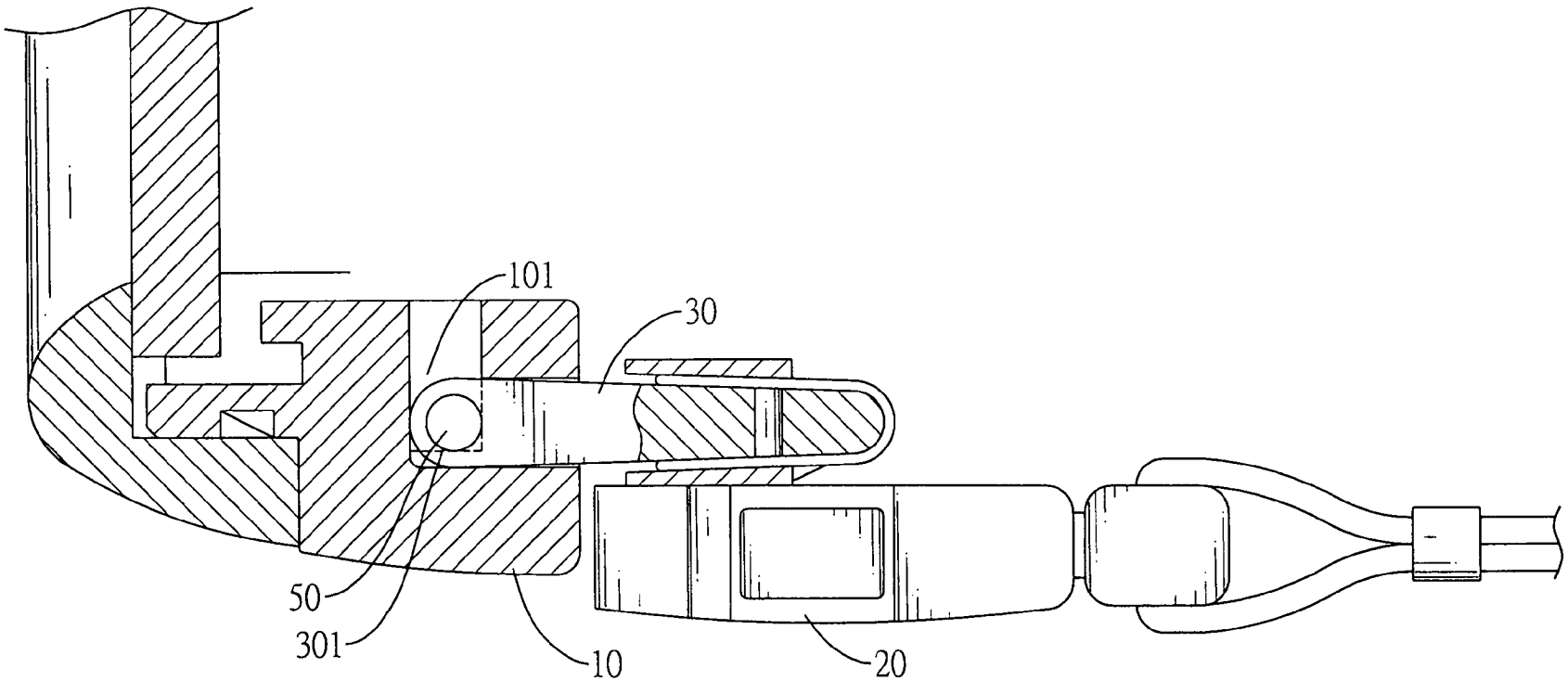
FIG. 4 is a cross sectional view of the present invention.

With reference to FIGS. 1–4, a diving mask includes a mask portion and a pair of side buckles (20) respectively extending rearwards from the left and right sides of the mask portion. A head band is connected between the side buckles (20). A structure that permits an easy adjustment in the relative positions between the mask portion and the pair of the side buckles (20) is adopted in the aforementioned diving mask. Two coupling blocks (30) made of flexible material, such as rubber or silicone, are respectively defined between two lateral sides of the mask portion and the pair of the side buckles (20). The mask portion further includes a solid lens frame (10) with a soft material skirt for covering the driver's face and a pair of lenses (100) fixedly mounted in the lens frame (10). Two grooves (101) are respectively defined in the two opposite sides of the lens frame (10). Two pivot holes (102) are respectively defined in an upper side and a lower side of the groove (101). The coupling block (30) has a left end facing to the lens frame (10) and a right end. The left end of the coupling block (30) is inserted into the groove (101). A housing (201) having an opening defined therethrough is formed on one lateral side of the side buckle (20). The housing (201) has a first edge near to the coupling block (30) and a second edge opposite to the first edge.

The coupling block (30) has a rectangular cross section. A first hole (301) and a second hole (302) perpendicular to the first hole (301) are respectively defined in the left and right ends of the coupling block (30). The coupling block (30) is pivotally connected to the lens frame (10) and the side buckle (20) respectively via a pin (50) and a U-clip (40). In practice, the pin (50) can be a flexible rod or a rod with two retractable ends to allow two ends of the pin (50) to enter into the pivot holes (102) through the groove (101). A rod (400) securely extends between two opposite inner walls of the clip (40). A stop (401) is defined on one side of the clip (40).

In assembly, firstly, the pin (50) is inserted into the first hole (301). Then, the left end of the coupling block (30) is inserted into the groove (101). Two ends of the pin (50) are respectively inserted into the two pivot holes (102). The rod (400) extends through the second hole (302) to link the clip (40) to the coupling block (30). Afterwards, the clip (40) together with the coupling block (30) is inserted into the housing (201). The stop (401) is blocked by the second edge of the housing (201). Inner walls of the housing (201) press against two opposite outer sides of the clip (40). Thus, the inner walls of the clip (40) abut two ends of the rod (400) more tightly to prevent the rod (400) from escaping from the second hole (302).

The side buckle (20) permits pivotal motion upwards/downwards or leftwards/rightwards relative to the lens frame (10) respectively by taking advantage of the rod (400) and the pin (50). A diver will feel comfortable when wearing the diving mask of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A diving mask comprising:

a lens frame (10) having a soft material skirt for covering the diver's face and a pair of lenses (100) fixed mounted in the lens frame (10) wherein the lens frame (10) has two grooves (101) defined at two ends of the lens frame (10), each groove (101) has two pivot holes (101) respectively defined in an upper side and a lower side of the groove two coupling blocks (30) adjustably provided at two ends of the lens frame (10);

two side buckles (20) mounted respectfully on the coupling blocks (30) each of the side buckles (20) has a housing (201) formed on a lateral side of the side buckle (20), the housing (201) has an opening defined through the housing, a first edge near to the coupling block (30) and a second edge opposite to the first edges the coupling block (30) has a first hole (301) and defined at a right end of the coupling block (30), and is pivotally connected to the lens frame (10) and the side buckle (20) respectively by a pin (50) extended through the first hole (301), and a clip (40) inserted in the housing (201); and a head band connected between the side buckles (20).

2. The diving mask as claimed in claim 1, wherein the clip (40) is U-shaped, a rod (400) extending through the second hole (302) abuts two inner walls of the clip (40), and a stop (401) formed on a lateral side of the clip (40) is blocked by the second edge of the housing (201).

* * * * *